United States Patent [19]

Heckaman et al.

[11] Patent Number: 4,641,140

[45] Date of Patent: Feb. 3, 1987

[54] MINIATURIZED MICROWAVE TRANSMISSION LINK

[75] Inventors: Douglas E. Heckaman, Indialantic; Roger H. Higman; Jeffrey A. Frisco, both of Palm Bay, all of Fla.

[73] Assignee: Harris Corporation, Melbourne, Fla.

[21] Appl. No.: 535,924

[22] Filed: Sep. 26, 1983

[51] Int. Cl.[4] ..... H01Q 3/22; H01Q 3/24; H01Q 3/26

[52] U.S. Cl. ..... 342/371; 333/236; 333/243; 333/245; 343/700 MS

[58] Field of Search ..... 333/236, 238, 243, 246, 333/245; 174/117 R, 117 F, 35 R, 36; 343/700 MS File, 371

[56] References Cited

U.S. PATENT DOCUMENTS

| | | | |
|---|---|---|---|
| 2,019,625 | 11/1935 | O'Brien . | |
| 2,721,312 | 10/1955 | Grieg et al. | 333/238 |
| 2,842,637 | 7/1958 | Adams et al. | 333/238 X |
| 2,932,687 | 4/1960 | Cook | 174/117 R |
| 3,076,862 | 2/1963 | Luedicke et al. . | |
| 3,191,100 | 6/1965 | Sorviilo . | |
| 3,277,347 | 10/1966 | Ecker . | |
| 3,293,353 | 12/1966 | Hendriks et al. . | |
| 3,563,630 | 2/1971 | Anderson et al. | 333/238 X |
| 3,663,739 | 5/1972 | Chevrier | 174/36 |
| 3,775,552 | 11/1973 | Schumacher | 174/117 F X |
| 4,030,001 | 6/1977 | Medley, Jr. et al. | 357/74 X |
| 4,288,841 | 9/1981 | Grogal | 357/74 X |
| 4,353,040 | 10/1982 | Krumm et al. . | |

FOREIGN PATENT DOCUMENTS

| | | | |
|---|---|---|---|
| 156685 | 5/1984 | Australia | 333/236 |

OTHER PUBLICATIONS

Harvey, *Parallel-Plate Transmission Systems for Microwave Frequencies,* the IEEE Paper No. 2770e, Mar. 1959, pp. 129–140.

Wilson et al., *Wire Line–A New and Easy Method of Microwave Circuit Construction,* QST, Jul. 1981, pp. 21–23.

Howe, Jr. *Stripline Circuit Design,* Aertech House, Dedham, Mass., 1974, Title Page & p. 34 Cited.

*Primary Examiner*—Paul Gensler

*Attorney, Agent, or Firm*—Antonelli, Terry & Wands

[57] ABSTRACT

A miniaturized microwave transmission link comprises short links of dielectric coated fine wire overlying a ground plane between signal coupling/launching pins of MICs. A dielectric cap is provided at each wire-pin termination and a layer of conductive foil is pressed onto the overall structure to form a conformal tunnel/-channel microwave transmission line configuration. The resulting tunneline, and/or channeline transmission line structure may connect MICs in a compact housing or provide access from external terminals to leads in a IC chip.

36 Claims, 13 Drawing Figures

$T_1$
$T_2$
$L_1$
$L_2$
$C_1$
$C_2$
$H_c$
$D_I$
$D_G$

MINIATURIZED MICROWAVE TRANSMISSION LINK

FIELD OF THE INVENTION

The present invention relates generally to a microwave transmission medium and, more particularly to a transmission line structure of ultraminiature size and flexibility.

BACKGROUND OF THE INVENTION

For the purpose of integrating RF equipment, it has been common practice in the art to interconnect modules by means of coaxial cables, or by placing a large number of hybrid integrated circuits inside a large module. Disadvantageously, however, the use of coaxial cable involves a large volume and weight, while incorporating many circuits in a single large module lowers its reliability, and results in a non-standard module which may also be difficult to seal hermetically.

A scheme developed by the Assignee of the present application for eliminating the shortcomings of these conventional techniques involves the use of short links of fine (e.g. No. 36) wire which are surrounded by a suitable dielectric covering or jacket (e.g. Teflon) and which overlie one surface of a conductive planar module board. The modules are mounted on the opposite side of the board and pin connections thereto extend through apertures in the board so that the links of wire may be connected to the pins. A thin sheet of conductive foil, such as aluminum foil, is pressed onto the board, so that the wires effectively create microwave transmission "tunnels" in the foil. This transmission medium, termed "tunneline", allows the use of individualized, standard off-the-shelf modules and eliminates the large volume and weight associated with coaxial cable interconnects. Moreover because of its flexibility it may be employed in conformal structures that do not readily lend themselves to use with other types of transmission media, such as stripline or microstrip, and offers packaging advantages over conventional transmission structures in terms of component density, isolation, heat transfer and bandwidth.

Now, while the flexibility and miniaturization characteristics of the tramsission highway structure of tunneline offer a significant improvement over previous approaches, it has been found that the extremely high precision with which the apertures for module pin connections must be patterned in the support board has prevented practical application of tunneline to a wide spectrum of microwave component support and interconnect structures.

SUMMARY OF THE INVENTION

In accordance with the present invention, a new and improved microwave component packaging and transmission line structure is provided which enjoys the miniaturization and flexibility aspects of tunneline but does not suffer from the high precision requirements for forming an apertured mounting board through which would otherwise pass the connection pins to the various micro components that would be support-coupled to the board.

Pursuant to a first aspect of the present invention, rather than employ a costly-to-produce mounting board, i.e. one in which the through holes or apertures for pin-to-tunneline connections must be preestablished, the present invention provides a new and improved termination structure for the ends of the wire links as well as an enhanced packaging configuration for the components themselves. The termination structure is such that the tunneline highways may be employed without the need for an apertured mounting board, yet the desired RF coupling is still attained.

For this purpose, the microwave components that are arranged in a module of interest are provided with a conductive iris or apertured disc that surrounds a pin extension for a respective component in the module so that the pin extends through the aperture in the iris. Typically, such microwave components employ a glass medium encapsulation through which pin connections from internal circuitry extend to the outside world. The terminated end of a wire link is such that a defined short length of bare wire extends from its dielectric jacket and is joined (as by soldering) in intimate contact with a pin. The termination end of the dielectric jacket is substantially aligned with the inner diameter of the iris and the exposed wire-to-pin conductive joint is encapsulated in a dielectric bead.

A thin layer of conductive foil tape is disposed over the modules to form a ground plane over which the dielectric-jacketed wire is extended between module pins. Pressed onto this structure is an overlying layer of conductive foil (e.g. aluminum foil) to form a "tunnel-like" channel through which the fine diameter jacketed-wire passes. The overlying layer of foil contacts the underlying layer of foil or other conductive plane material contiguous with the foil over which the jacketed-wire passes so that the continuous microwave transmission line is formed between pins connected by the wire link. Because the overlayer of foil extends atop the dielectric beads at an iris/pin termination, and because of the iris itself, there is obtained the required RF capacitive coupling at the termination of the wire, to overcome the induced inductive impedance of the wire that extends from a dielectric jacket end portion at its conductive joint with a module pin, to thereby achieve a complete microwave coupling at the joint.

Using the above scheme, the modules may be housed in a conductive unit, sized to receive a plurality (e.g. a pair) of micro circuit module packages. These are typically rectangular-shaped with conductive heat-transferring side walls. The width of a slot into which a pair of modules is inserted is slightly oversized, and a thin spring member is inserted into the space between the module packages. Flexing protrusions of the spring member push against adjacent side walls of the module packages to urge the opposite side walls thereof into intimate contact with the inner side walls of the slot, thereby achieving a high thermal transfer capability between the module packages and the support housing. Thin strips of foil tape bridge the spring-coupled joint between each package and the ends of the slot, and the tunneline wire channels are arranged over these strips, as explained above. A cushioning pad, e.g. a foam or mesh plastic or rubber material, is compressed atop this top foil layer by a housing cover, to provide a shock resistant structure and to compress the upper foil layer around the jacketed-wires and thereby assure a complete microwave link between interconnected pins of the modules.

In accordance with another aspect of the invention, rather than dispose the foil-covered jacketed-wires above a microcircuit structure of interest, to create "tunnels" through the ground plane foil, a thin (e.g.

one-sixteenth of an inch) ground plane board or plate in which transmission channel tracks or grooves are formed (as by machining, etching, etc.) may be used. The thin dielectric jacketed-wire is placed in the grooves, which may intersect one another to allow for wire cross-overs, and a conductive foil layer is formed over the wired channels or grooves in the conductive plate. The size and shape of the grooves and the size of the wire establish the characteristic impedance of the transmission line that runs along the grooves. Connections to microcircuit components are effected by providing through-holes in the channels to the other side of the plate and providing pin connections to the center wire conductors disposed in the channels thereat. As the transmission line formed by the technique is formed in "channels" in a ground plane board or plate, it will be termed "channeline" herein.

Because of its inherently compact and predeterminable configuration, channeline is particularly useful for forming a multi-element antenna structure, such as an interconnect for a phased array antenna matrix. Such a structure may be formed of a thin conductive plate in one side of which is formed a preset pattern of grooves or channels for establishing the highways for interconnecting the antenna elements. The other side of the plate is coated with a layer of dielectric, (e.g. Teflon-glass) and individual elements of the antenna are formed atop the glass layer. Through-holes extend from the elements to the channels through the dielectric and plate, for receiving pin interconnects between the conductive material of the antenna elements and the center wire of the channeline. As this structure may be made very thin, it is especially useful for conformal structures, such as high performance aircraft. Moreover, since a large number of multilevel layers are not required, production yield is significantly improved over conventional approaches.

Because of the diversified and compact nature of tunneline and channeline, they may be used together to provide improved signal coupling arrangements where highly reliable miniaturized packaging is mandated. For example, these two transmission line configurations may be incorporated together to provide an improved signal lead out arrangement for a leadless microchip. For this purpose, the chip housing structure may be provided with a circumferentially disposed slotted plate in respective slots or grooves of which the channeline extends. The slotted plate is, in turn, surrounded by a ground plane/heat sink support plate contiguous therewith and over which the jacketed conductor of the tunneline fans out to external packaging connection terminals. The jacketed conductor terminates at the side of the leadless chip and a conductive foil overlies the chip, terminators, channeline slots, and tunneline fan-outs to complete the multi-channel lead out transmission line structure. This configuration is especially suited for ease of removal of the chip where repair or replacement may be necessary.

DETAILED DESCRIPTION

Figures 1, 2, 3, 4:
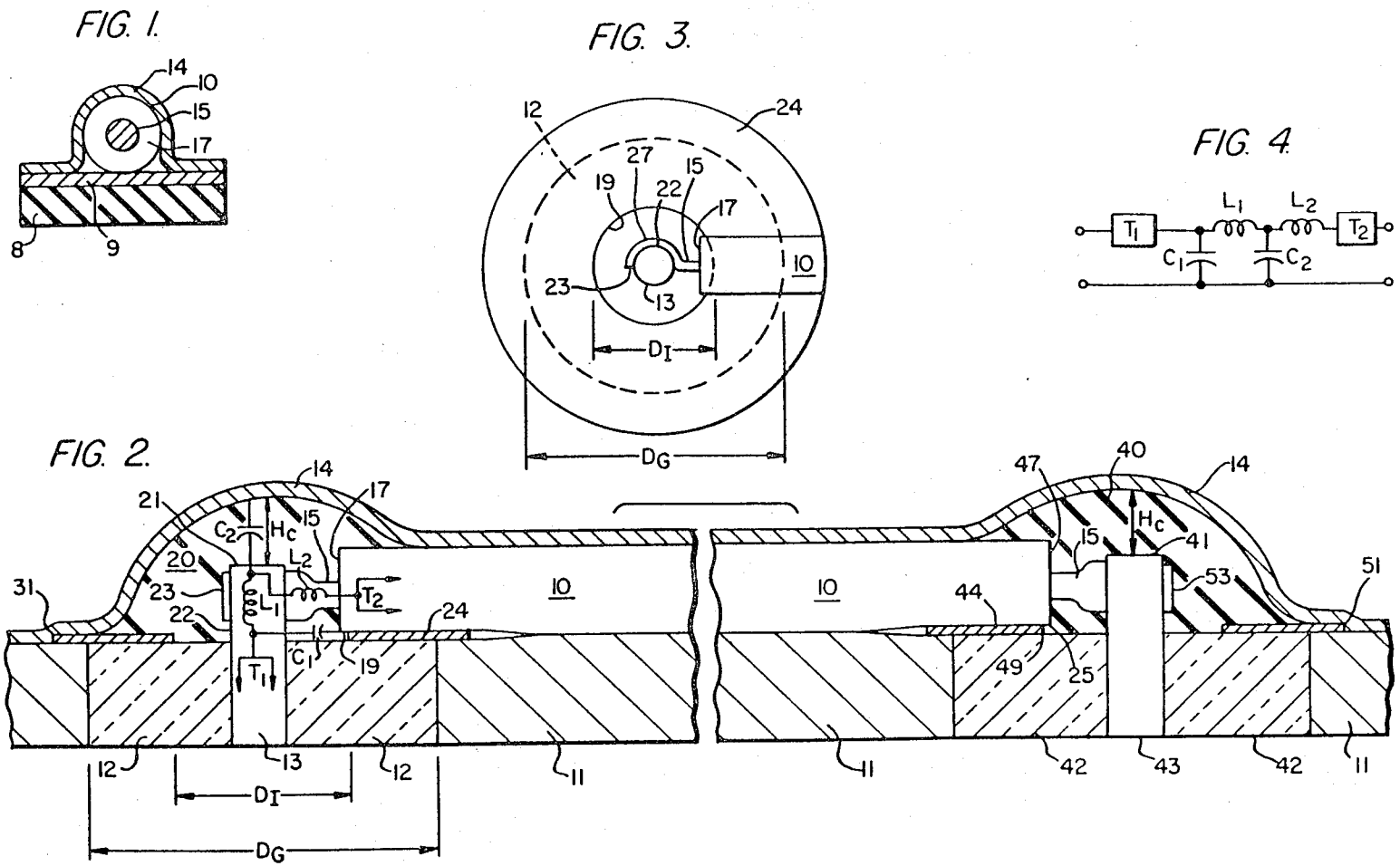
FIG. 1 is an enlarged cross-sectional end view of a section of tunneline overlying a support substrate.
FIG. 2 is a cross-sectional side view of a section of tunneline extending over a support housing and terminating at respective module connection pins.
FIG. 3 is a plan view of the wire-to-pin/iris configuration of a tunneline termination.
FIG. 4 shows an equivalent circuit diagram of the termination of section of tunneline as shown in FIGS. 2 and 3.

Referring initially to FIG. 1, there is shown an enlarged cross-sectional end view of a section of "tunneline" overlying a support substrate. Atop a substrate 8 is a ground plane or conductor layer 9 over which a fine diameter jacketed-wire 10 is disposed. The wire 10 contains a center conductor 15 surrounded by a dielectric jacket 17 (e.g. Teflon). For present day miniaturized components, Teflon-coated number-36 wire or the like has been found suitable for the basic wire structure. Overlying the wire 10 is a thin foil layer (e.g. aluminum foil) 14 that snugly surrounds the wire and hugs the surface of the conductor layer 9. Because of the manner in which the foil 14 overlies or is "raised up" by the wire, the transmission medium appears to resemble a tunnel, so that the transmission medium may be termed "tunneline".

A cross-sectional side view of a section of tunneline terminating at a pair of respective MIC (microwave integrated circuit) component pins is shown in FIG. 2, while an enlarged plan view of the termination configuration for one of the pins is shown in FIG. 3. The tunneline itself is shown as comprising jacketed-wire 10, the center conductor 15 of which extends beyond respective end portions 17 and 47 of the jacket and is partially wrapped around respective MIC pins 13 and 43. Pin 13 extends vertically through a glass seal 12 provided in a conductive housing 11 in which one or more MIC components is provided. As shown in FIG. 3, with a portion of the jacket (e.g. Teflon insulator) of the wire 10 removed, the center wire 15 is bent to form a semicircular bend 27 terminating at end 23 and abutting against the outer cylindrical surface of pin 13 at a solder joint 22. Pin 13 may be a gold-plated Kovar pin so as to facilitate the formation of a solder joint between wire 15 and pin 13 itself. The module component-tunneline termination configuration shown in the left-hand portion of FIG. 2 further includes an aluminum foil iris or disc 24 that sits atop and bridges the physical insulator/conductor joint between the glass 12 and the conductive housing 11. The inner edge 19 of the central aperture of the iris 24 is spaced very slightly from the end 17 of the jacket of the wire 10 or it may be substantially flush therewith.

The solder joint between the center conductor wire 15 and the pin 13 is encased in a dielectric cap 20 comprised of a suitable low loss material such as a Stycast compound. The dielectric cap 20 extends onto the surface of the iris 24, the outer diameter of which terminates at edge 31 overlying the conductive housing 11 as shown. The thickness of the cap 20 is such as to provide a spacing $H_c$ between the roof of the cap and the top portion 21 of the pin 13. The foil portion 14 of the tunneline extends over the wire 10 and over the entirety of the cap 20 and on to the conductive housing 11 beyond the outer diameter of the iris 31, as shown, so as to provide a complete transmission-line termination at pin 13.

A similar termination configuration is shown in the right hand portion of FIG. 2 for another MIC component having a pin 43 which passes through a glass seal 42. Bridging the conductive housing 11 and the seal 42 is conductive foil iris 44. The soldered connection between wire 15 and pin 43 is also embedded or encased in a dielectric cap 40 over which the foil layer 14 extends so as to completely surround the dielectric cap 40, just as dielectric cap 20 is completely surrounded by the conductive foil 14.

Schematically superimposed on the termination structure in the left hand portion of FIG. 2 and shown separately in FIG. 4 is an equivalent circuit created by the components of the termination of the tunneline and an MIC pin pursuant to the present invention. Inductors L1 and L2 represent separate portions of a series inductance formed by right angle bend between the pin 13 and the center wire portion 15 of the tunneline wire. Between the pin 13 and the iris 24 a first capacitor C1 having a dielectric constant corresponding to that of the cap 20 is formed. A second capacitor C2 includes the capacitance of the pin 13-wire 15 bend and the capacitance through the dielectric cap 20 between the overlying foil layer 14 and the top of the pin 21. Element T1 corresponds to the transmission line through the pin 13 within the glass seal 12, while component T2 corresponds to the transmission line through the tunneline wire. Pursuant to the present invention, by the provision of the iris 24 and the extension of the aluminum layer 14 over a dielectric cap 20, the impedance characteristics definable by the equivalent circuit shown in FIG. 4 are substantially improved and it is possible to successfully launch signals between the MMIC elements and the tunneline 10.

As mentioned previously, original proposals employing tunneline involved the use of a support substrate in which through-holes were provided between respective modules and tunneline connection points. Unfortunately, the placement of a multiplicity of through holes in a support substrate to match the glass-sealed, feed-through pins which extend out of the hybrid modules requires extreme precision, so that it is both costly and time consuming. High precision is required because of the transition between the tunneline and the module pins and the need to insure the ability to launch signals between the tunneline and the modules.

By providing the termination configuration shown in detail in FIGS. 2 and 3, high precision in forming through holes in a support substrate is not necessary. In fact, as can be seen from FIGS. 2 and 3, a support substrate, as such, is not employed at all. Instead, the tunneline may be employed directly between the pins and the module housing through the use of a respective conductive foil iris, such as iris 24 which surrounds pin 13. For an exemplary range of microwave frequencies of interest, (e.g. 2–12 GHz) the iris 24 may comprise a thin layer of aluminum foil (e.g. 0.005 inches thick), having an inner (aperture) diameter on the order of 0.045 inches; typically, the diameter of pin 13 may be on the order of 0.015 inches. The height of dielectric cap 20 in this instance may be on the order of 0.050 inches with a spacing $H_c$ on the order of 0.020 inches. This provides a reduced overall size of the solder joint and surrounding termination material. Of course, the outer diameter of iris 24 is sufficient to overlap the glass/conductor joint and thereby be contiguous with the ground plane conductor 9. Preferably, the joint between the center wire 15 and the pin 13 is achieved by preforming the end of wire 15 in a semicircular configuration as shown in FIG. 3, mentioned previously, and carrying out resistive soldering to form an intimate joint 22.

Because of the use of the conductive (e.g. aluminum) iris 24, the dielectric cap 20 and the complete overlay of ground plane foil 14, substantial losses through the lumped impedance circuit formed at the joint, an equivalent diagram of which is shown in FIG. 4, referenced above, are substantially reduced, permitting an optimum match between MIC launching pin 13 and the tunneline to be achieved. While an inner diameter $D_I$ of 0.045 inches for the aluminum foil iris 24 has been given as an exemplary value, it is, of course, not limitative of the invention. Practical parametric values for this diameter $D_I$ are on the order of 0.040 inches–0.050 inches, with a foil thickness of 0.005 inches providing excellent results over the above-mentioned operation range.

In addition to providing the necessary pin-to-transmission link (tunneline) launch capabilities, the transition structure described above has a number of mechanical advantages, including the fact that a critically apertured support substrate is not required. Because a separate iris is employed for each module pin, namely iris 24 is employed for module pin 13, whereas a separate iris 44 is employed for module pin 43, location tolerances are substantially reduced. The thinness of each iris (on the order of 0.005 inches) relaxes the centering of the pin requirements. Finally, without the use of a support substrate, weight and volume of the overall packaging configuration is reduced.

Figure 5:
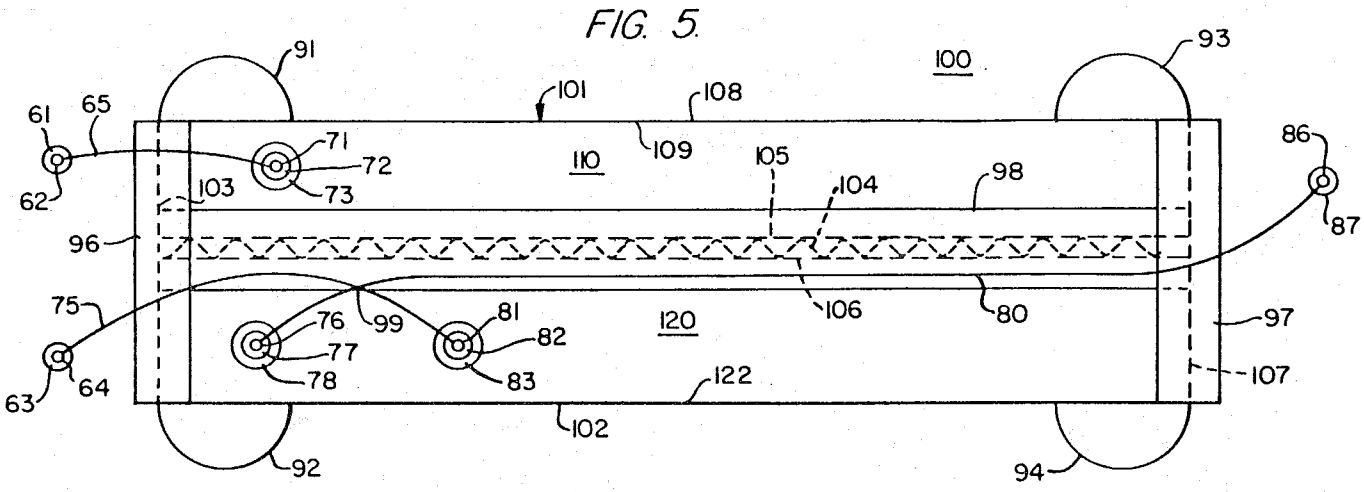
FIG. 5 is a plan view of a multiple module housing configuration employing tunneline and the tunneline termination structure shown in FIGS. 1–3.

A example of the application of the tunneline transition configuration shown in FIGS. 2 and 3 to MIC packaging is illustrated in FIG. 5 which shows a plan view of a novel module packaging arrangement containing a plurality of MICs. More particularly, structure comprises the packing of a housing 100 having a slot 101 for receiving a plurality (e.g. a pair) of rectilinearly-configured modules 110 and 120. Module 110 contains a plurality of MIC components, one of which is shown in the upper left hand portion of FIG. 5 as being provided with a center connection pin 71 which extends through a glass seal 72. Module 120 is also shown as being provided with a pair of MIC connection terminals, respectively comprised of a center pin 76 which passes through a glass seal 77 and a center pin 81 which passes through a glass seal 82. It should be realized that each of modules 110 and 120 typically contains more than the number of modules having connection pins shown; only a few are shown so as to simplify the drawing. Typically such modules have the microcircuit components therein distributed along the length of the module with connection pins extending through the respective cylindrical glass seal portions thereof. The exposed surfaces of the modules 110 and 120 are conductive and the sides thereof are normally employed as heat radiating surfaces from the modules to the surrounding housing.

Namely, outer side wall 109 of module 110 faces a corresponding inner side wall 108 of the slot 101 in the housing 100, slot 101 receiving modules 110 and 120. Similarly, an inner side wall 102 of slot 101 is designed to be in intimate contact with the outer side wall 122 of the module 120 for providing both good thermal and conductive coupling therebetween.

Figure 7:
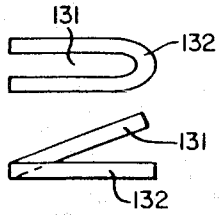
FIGS. 6 and 7 are respective plan and side views of the configurations of spring member 104 of the multiple module housing shown in FIG. 5.
Figure 6:
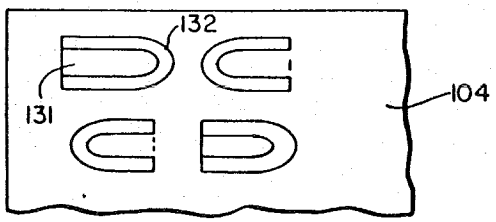

The module receiving slot 101 in housing 100 also contains respective pairs of semicircular cut-out regions 91–92, 93–94 to facilitate placement and removal of the modules in the housing. End walls 103 and 107 further define the ends of the slot 101 into which the modules 110 and 120 are inserted. The inner side wall 105 of module 110 and the inner side wall 106 of module 120 face one another and are urged apart from one another by a spring member 104. As shown in FIGS. 6 and 7 spring member 104 comprises a thin metal (e.g. copper) sheet, having a plurality of fingers or flaps 131 formed in respective slots 132 in a thin ribbon like material and bent away from the original surface of sheet 104. The thickness of the modules 110 and 120, namely the distance between side walls 109 and 105 and side walls 122 and 106 thereof, is slightly narrower than the separation between side walls 108 and 102 of the slot 101 in the housing 100. The modules are placed against one another with spring 104 sandwiched and flattened therebetween and dropped into the slot. The fingers 131 of the spring then urge the modules apart so that side walls thereof are in intimate contact with one another to facilitate thermal and conductive coupling therebetween. The spring member 104 also provides mechanical coupling of the modules in the housing and acts as a shock absorber.

On the top surface of the modules, a strip of conductive foil tape 98 is placed along the center joint, overlapping spring member 104 and the inner side walls 105 and 106 of modules 110 and 120, respectively. At the opposite ends of conductive foil tape 98 respective conductive foil tape sections 96 and 97 are provided to overlap the ends of the modules 110 and 120 and to bridge those ends with the conductive surface of housing 100; namely the ends 103 and 107 of the slot are bridged by tape sections 96 and 97. The tape sections 96, 97 and 98 provide a continuous ground plane over which the tunneline may be provided. The tunneline wire is shown in FIG. 5 simply as wires 65, 75 and 80. Wire 65 connects a pin 62 of an MIC component disposed within the housing 100, but external to modules 110 and 120, to pin 71. Pin 62 is shown as being surrounded by cylindrical glass seal 61, whereas glass seal 72 is provided with a conductive iris 73 for the termination joint as discussed above and illustrated in FIGS. 2 and 3. For connecting a component having central pin 76 within module 120 to another component external of that module, tunneline wire 80 runs from pin 76 over the conductive foil tape 98 and tape portion 97 and is joined to (soldered) a center pin 86 surrounded by a glass sleeve 87 at another portion of the housing 100. Similarly, a connection from an MIC component having a pin 81 in module 120 is provided by wire 75 which connects the center pin 81 thereof to a pin shown as 64 which in turn is surrounded by a glass sleeve 63 in another portion of the housing 100. Note that pins 62, 64 and 86 at separate portions of housing 100 may correspond to MIC components that are provided in portions of the housing 100 other than where the modules 110 and 120 are provided, and may be introduced through respective bores at an opposite side of the housing from the side shown in the Figure.

The configurations of the structures of these components are not critical to the invention and is, accordingly, not shown in the drawing. What is of significance in FIG. 5 is the manner in which the modules 110 and 120 are provided in a common rectangular slot in the housing 100 and are provided with thermal and mechanical shock biasing spring 104 together with the conductive foil tapes overlying the modules to meet the requirements of the novel tunneline interconnection and terminations. The dielectric beads and overlying aluminum foil for the components of the modules 110 and 120 and the external MIC components at pins 62, 64 and 86 have not been shown in FIG. 5 to simplify the drawing. Again, attention may be directed to FIG. 2 for an illustration of the details of a tunneline termination. Still, it should be realized that such a tunneline termination is employed in the configuration shown in FIG. 5.

Advantageously, because of the compact size of the wire employed, the tunneline wires themselves may cross over one another, as at 99, with an overlying aluminum foil layer being placed on the completed structure once the dielectric termination beads have been provided. The packaging is completed by providing a foam rubber pad to compress the aluminum foil onto the inserted modules and then a housing cover is provided to compress the foam and urge the aluminum foil into intimate contact so that it is effectively snugly pressed onto the structure over which it is placed.

Figure 8:
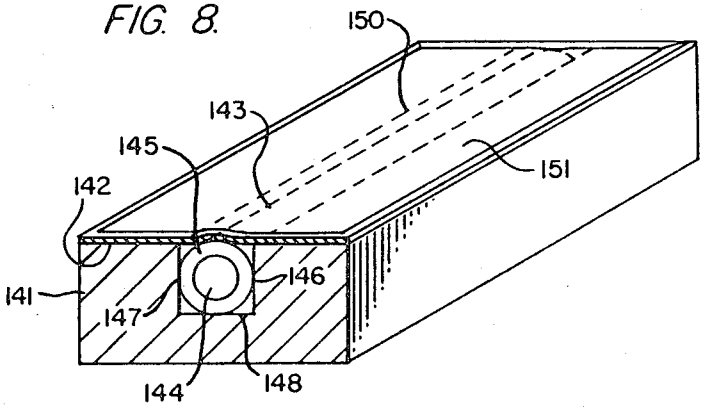
FIG. 8 is a pictorial view of a section of channeline structure according to the present invention.

Referring now to FIG. 8, a "channeline" configuration of the compact microwave transmission link according to the present invention is illustrated in a perspective view showing the disposition of dielectric jacketed-wire 143 in a groove or "channel" 150 provided in a thin conductive plate 141. The channel 150 has a substantially rectangular or square cross-section defined by a pair of side walls 147 and 146 and a bottom wall 148. Jacketed-wire 143 having center conductor 144, surrounded by dielectric insulator jacket 145, is placed in the channel 150 so that it is surrounded on three sides by the side walls 146, 147 and bottom 148 of the slot 150 in conductive plate 141. A conductive foil layer 151 is then positioned in intimate contact with the top of the wire 143 and the top surface 142 of plate 141.

Figure 9:
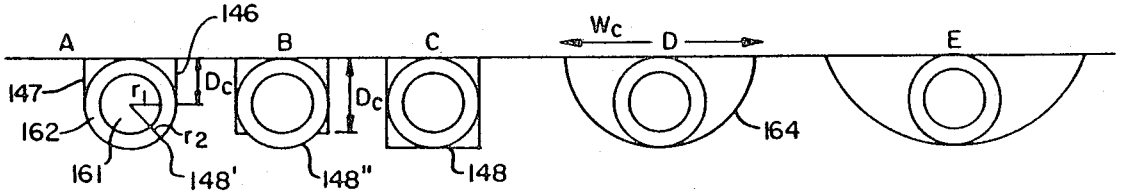
FIG. 9 shows a cross-sectional end view of various configurations of channeline structure.

The characteristic impedance of this "channeline" configuration of the microwave transmission line of the present invention is determined by the diameter of the center conductor 144, the dielectric insulator jacket 145 and the channel width shape. Again, the wire of interest may be number-36 Teflon-coated conductor 144, with a Teflon jacket 147 also having a circular cross-section. FIG. 9 illustrates a variation in shapes of the channel or groove in which the wire may be placed for varying the characteristic impedance along the channel. The radius of the center conductor is noted by $r_1$ while that of the total wire, both center conductor and jacket, is denoted by $r_2$. With a fixed channel depth-to-center conductor ratio, a characteristic impedance range of approximately 1.4:1 is available as a function of channel width shape. In part A of FIG. 9, side walls 146 and 147 of the channel have a depth $D_c$ corresponding to the radius $r_2$ of the wire; the bottom wall 148' is shown as semicircular of radius $r_2$. The width of the channel $W_c$ is equal to the diameter of the wire. In FIGS. 9B and 9C, the width of the channel $W_c$ is also equal to the overall diameter of the wire, including outer Teflon jacket, but the depth $D_c$ of the side walls 146 and 147 configuration shown in FIG. 9B is less than the diameter of the wire and the bottom 148'' has a curved trough for receiving the wire.

In FIG. 9C the depth of side walls 146 and 147 is equal to the diameter of the wire.

With the increasing depth of the channel, there is also an increase in the characteristic impedance. The characteristic impedance may also be increased by increasing the size of the channel, as by altering its shape (including its width $W_c$) as shown in FIGS. 9D and 9E. In each of these illustration, the cross-section of the channel is defined by semicircular wall 164, the depth in each case being equal to the diameter of the wire. The width $W_c$, however, increases from the width of the wire, as shown in FIG. 9C to twice the diameter of the cable and to greater values as shown in FIGS. 9D and 9E, resulting in a further increase in the characteristic impedance.

The characteristic impedance may be further increased by changing the ratio of the radius of the center conductor to that of the overall wire. As the ratio of the radius of the jacketed-wire to the radius of the center conductor increases, there is a corresponding increase in characteristic impedance. For purposes of providing an illustrative parametric range, high temperature Teflon-coated wire (e.g. 30–40 gauge wire), available from W. L. Gore and Associates, Inc. Newark, Del., allows a characteristic impedance range from 20 ohms to 70 ohms. For a variation in radius ratio of R1/R2=0.020/0.032 to R1/R2=0.020/0.050, a variation of impedance of 22 ohms–50 ohms using the channel cross-section configurations of FIGS. 9A–9E was obtained. It should be noted that for accurately controlling the characteristic impedance of the transmission link, the center conductor of the wire employed should be uniformly concentric with its surrounding insulator along its length. Wire available from W. L. Gore & Associates, Inc., reference above, has been found to satisfy this need.

Figure 10:
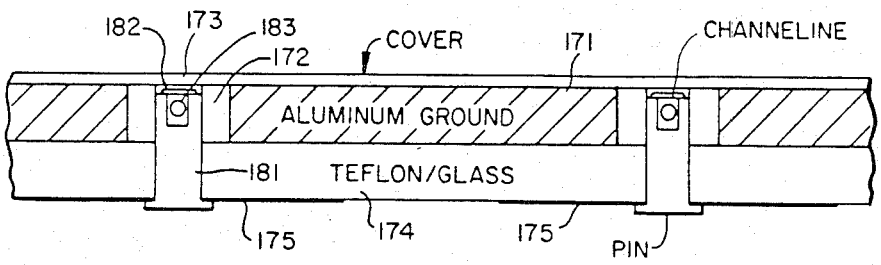
FIG. 10 is a cross-sectional view of a portion of a phased array antenna having a channeline feed network.
Figure 11:
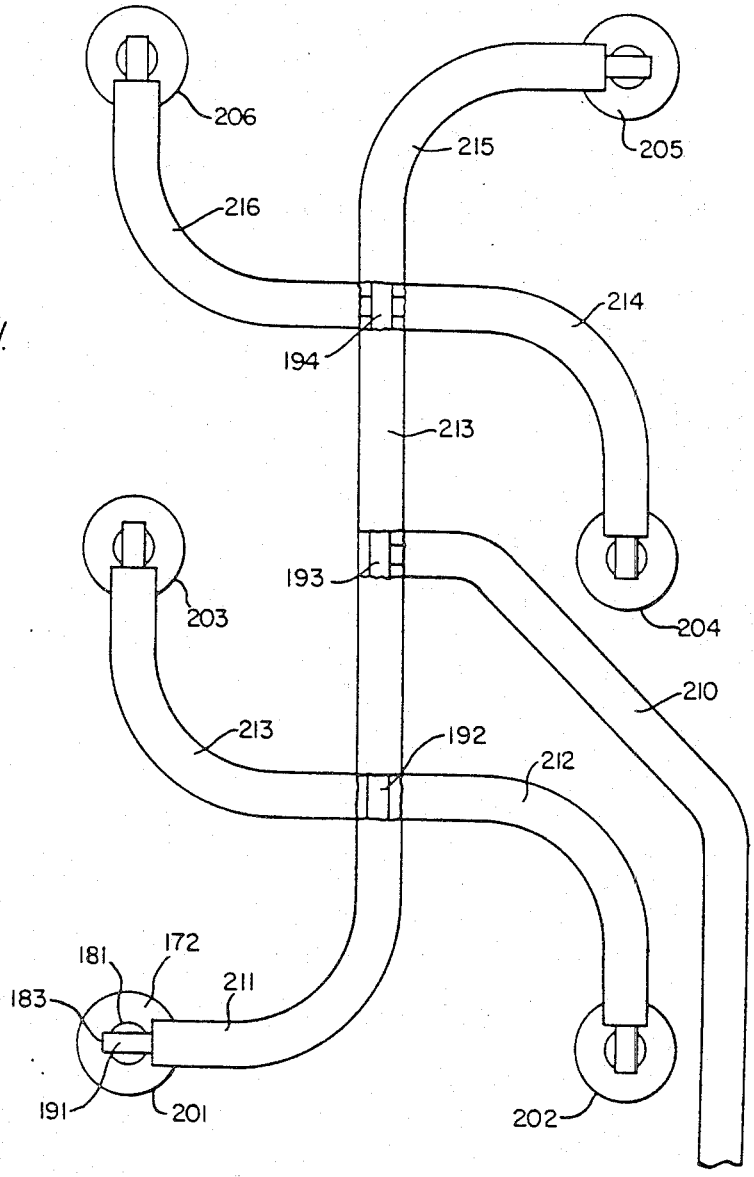
FIG. 11 is a plan view of a portion of a phased array antenna coupling a channeline feed network.

FIGS. 10 and 11 illustrate respective cross-sectional and plan views of an application of channeline as a feed network for a phased array antenna. As shown in the cross-sectional illustration of FIG. 10, such an antenna, which may be employed for flat or conformal applications as on an airborne structure, may comprise a single sheet of metalized dielectric material (e.g. Teflon/glass) 174 bonded to a thin conductive ground plate 171. The metalization is shown in FIG. 10 as selectively formed antenna element regions 175 on the Teflon/glass 174 which is bonded to conductive plate 171. Apertures are provided through the Teflon/glass and the aluminum ground plate 171 for conductive pins 181 which extend from the antenna elements 175 and contain slots 182 for receiving the center conductive 183 of the channeline wire. A cylindrical dielectric 172 surrounds the pin 181 as it passes through the aluminum ground plate 171. Finally, a conductive cover 173, such as aluminum foil, is formed over the channeline wires.

A plan view of a portion of a feed network is shown in FIG. 11 wherein six antenna element regions 201–206 are interconnected by respective channeline segments 211–216. At cross-over points such as 192, 193 and 194, the center conductors are interconnected to one another and ultimately via cross-over point 193 to a lead out conductor 210.

Construction of a feed array as shown in FIGS. 10 and 11 is achieved by performing the prescribed pattern of grooves in the aluminum ground plate 171, such as those having a layout as shown in FIG. 11 and then bonding the aluminum to the dielectric layer 174 through which apertures are provided where the antenna elements are to be formed. The selective patterning of the metalization on the dielectric layer provides the antenna elements themselves and connections to the various elements is achieved by simply inserting the runs of wire in the channels or grooves as shown in FIG. 11, providing connections via pins such as at 181 and overlaying a layer of aluminum foil 173.

Because of the thinness of the package (the aluminum ground plate, for example, may be on the order of 1/16th of an inch thick,) the Teflon-glass-metal laminate containing the channeline is readily conformal to airframe packages (e.g. missiles) and is considerably simpler to manufacture than complicated multilayer stripline type feed networks currently being employed. Stripline is significantly more lossy than a waveguide feed/network but is often the selected transmission line configuration for small arrays because of element compatibility, size, weight and cost advantages. In the present state of the art, Teflon/glass is the material employed for low loss producing stripline. However, it is disadvantageous due to its development costs, high material and labor costs, questionable reliability of plated through holes in the Teflon, a limited upper temperature limit and conformal limitations. In place of stripline, as noted above, the present invention offers a significantly enhanced (in terms of simplicity and manufacture) waveguide structure that amounts to simply using an additional layer (a thin aluminum plate) that is channeled or grooved and into which channels or grooves the channeline wires are inserted and then covered with a thin aluminum foil layer 173 atop the package. The channeline transmission link configuration shown in FIGS. 8–11 has useful application from UHF—40 GHz.

Because of its simplicity and compactness, the tunneline/channeline configuration of the microwave transmission link according to the present invention offers a significantly improved technique of providing external terminal connection to monolithic integrated circuit chips.

Figure 12:
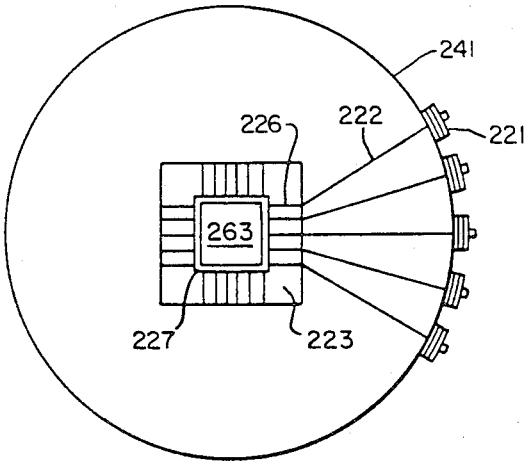
FIG. 12 is a plan view of a leadless chip packaging structure having tunneline/channeline lead outs.

FIG. 12 illustrates a plan view of a high speed/microwave chip carrier package having a channeline/tunneline transmission line interface. The package is comprised of a flat cylindrical conductive (aluminum) housing 241 having a plurality of terminals 221 provided around the exterior circumference of the housing. Each terminal is provided with a channeline/tunneline fine diameter jacketed-wire lead-in 222 which lays flat on the surface of the housing and is guided through a respective channel 226 in a channel guide 223 and terminates at the leadless chip package 263. The center conductor wire of each jacketed-wire portion extends from the channel 226 and rests upon an insulator frame 227 to be contacted by the leadless chip when placed into the housing.

Figure 13:
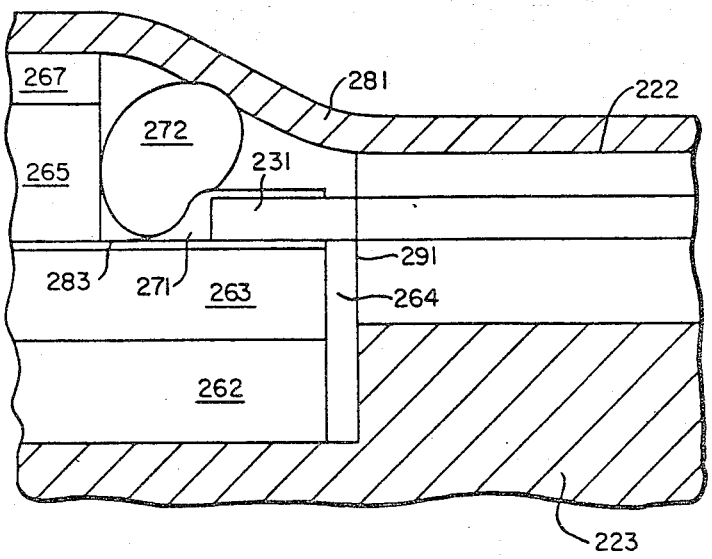
FIG. 13 is a cross-sectional side view the channeline or tunneline termination portion of a chip lead out for a leadless chip package.

FIG. 13 shows an enlarged cross-sectional view of the interface of the channeline/tunneline conductor wire 222 with the ceramic chip carrier. A depression in the chip carrier housing structure which includes the channeline guide section 223 is provided with a conductive layer 262 atop which sits the ceramic package of interest 263 (e.g. containing GaAs monolithic circuit). The center conductor 231 of the channeline/tunneline wire protrudes from the end of the jacketed portion thereof at 291 and intimately contacts a conductive plated highway 283 on the ceramic package 263. A dielectric layer 271 is coated over the center conductor extension 231 and a dielectric spacer 272 (e.g. O-ring) is formed around chip package 265 which overlies the selectively plated areas 283. The upper surface of package 265 is provided with a metal plated layer 267 atop which and atop the channels 226 and the surface of the housing 241 a conductive foil layer 281 is provided.

Because of the close proximity of the termination of the channeline wire conductor 231 and the plated conductor pattern 283 on ceramic package 263 and the provision of a continuous foil layer 281, successful microwave signal launching capabilities between the package and the channeline are provided. The dual use of channeline and tunneline affords the structural mounting features of channeline (at the periphery of the chip in the channeline guide 223, and the flexibility of the fan-outs to the external terminals 221, thereby facilitating packaging construction and each of replacement and/or repair.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed:

1. For use in effecting electrical signal transmission at microwave frequencies between spaced apart microwave signalling components, each of said components having a terminal pin extending through a dielectric insulator material and provided with a ground plane conductor surrounding said dielectric insulator material, a transmission link comprising:

a first layer of conductive material disposed between said components as to provide a ground plane contiguous with the surrounding ground plane conductors thereof;

a dielectric-surrounded conductor overlying said first layer of conductive material, opposite ends of said dielectric-surrounded conductor being respectively connected to respective terminal pins of said components;

a respective iris member of conductive material provided at each terminal pin so as to partially overlap the dielectric insulator material through which the respective pin extends and the ground plane conductor surrounding said dielectric insulator material, and having an aperture through which said respective pin passes;

a dielectric insulator cap provided at each opposite end of said dielectric surrounded conductor, said cap surrounding said pin and its connection to said conductor; and a second layer of conductive material formed over said dielectric-surrounded conductor and said caps and being electrically connected with said first layer of conductive material.

2. A transmission link according to claim 1, wherein said second layer of conductive material comprises a layer of conductive foil.

3. A transmission link according to claim 1, wherein said dielectric surrounded conductor comprises a dielectric-jacketed fine diameter wire.

4. A transmission link according to claim 2, said first layer of conductive material includes a layer of conductive foil.

5. A transmission link according to claim 2, wherein said dielectric insulator material terminates adjacent to the edge of the aperture in said iris member.

6. A packaging-interconnection structure for miniaturized microwave signalling components comprising:

a conductive housing having a slot sized to receive a plurality of microwave signalling component-containing units provided therein, each of said units having at least one terminal pin extending through a dielectric insulator material and being provided with a ground plane conductor surrounding said dielectric insulator material; and means for effecting electrical signal transmission with respect to microwave signalling components contained in said units including a first layer of conductive material disposed between said components so as to provide a ground plane contiguous with the surrounding ground plane conductors thereof, a dielectric-surrounded conductor overlying said first layer of conductive material, one end of said conductor being connected to a terminal pin;

an iris member of conductive material provided at said terminal pin so as to partially overlap the dielectric insulator material through which the pin extends and the ground plane conductor surrounding the dielectric insulator material, and having an aperture through which the pin passes, a dielectric insulator cap surrounding said pin and its connection to said conductor, and a second layer of conductive material formed over said dielectric-surrounded conductor and said cap and being electrically connected with said first layer of conductive material.

7. A packaging interconnection structure according to claim 6, wherein said second layer of conductive material comprises a layer of conductive foil.

8. A packaging interconnection structure according to claim 6, wherein said dielectric surrounded conductor comprises a dielectric-jacketed fine diameter wire.

9. A packaging interconnection structure according to claim 6, wherein said first layer of conductive material includes a layer of conductive foil.

10. A packaging interconnection structure according to claim 6, wherein said dielectric insulator material terminates adjacent to the edge of the aperture in said iris member.

11. A packaging interconnection structure according to claim 6, further comprising a spring member inserted between adjacent ones of said units and urging said units against the side walls of said slot.

12. A packaging interconnection structure according to claim 6, wherein said conductive housing further includes an additional microwave signalling component exclusive of those provided in said units, each having a respective terminal pin extending through a dielectric insulator material and being provided with a ground plane conductor surrounding the dielectric insulator material; and wherein a second end of said dielectric-surrounded conductor is connected to the terminal pin of said additional microwave signalling components.

13. A packaging interconnection structure according to claim 12, further comprising an additional dielectric insulator cap surrounding the terminal pin of said additional component and its connection to said conductor, and wherein said second layer of conductive material extends over said additional dielectric insulator cap.

14. A packaging interconnection structure according to claim 12, further comprising a spring member inserted between adjacent ones of said units and urging said units against the side walls of said slot.

15. A packaging interconnection structure according to claim 14, wherein said first layer of conductive material includes strips of conductive material bridging physical interfaces among said units, and the sides of said slot.

16. A transmission line for use at microwave frequencies comprising:

a first layer of conductive material having a first surface in which a first channel devoid of said material is formed, said first channel extending in a first direction, and in which a second channel devoid of said material is formed, said second channel extending in a second direction different from said first direction and intersecting said first channel, and wherein the bottom of said first channel is contiguous with the bottom of said second channel;

a first insulator-surrounded conductor disposed in said first channel, the surrounding insulator of said first insulator-surrounded conductor only partially occupying the available space in said first channel external to said first conductor;

a second insulator-surrounded conductor disposed in said second channel, the surrounding insulator of said second insulator-surrounded conductor only partially occupying the available space in said second channel external to said second conductor; and a second layer of conductive material formed over said first and second channels in which said first and second insulator-surrounded conductors are respectively disposed.

17. A transmission line according to claim 16, wherein said first layer of conductive material comprises a thin conductive plate and said first and second insulator-surrounded conductors comprise respective first and second dielectric-jacketed fine diameter wires disposed in said first and second channels, respectively.

18. A transmission line according to claim 17, wherein said second layer of conductive material comprises a layer of conductive foil covering said channels and contacting the dielectric jackets of said wires and said first surface of said thin conductive plate.

19. A transmission line according to claim 18, wherein the depth of each of said channels is at least equal to the outer diameter of said conductors.

20. A transmission line according to claim 18, wherein the width of each of said channels is at least equal to the outer diameter of the conductor therein.

21. A transmission line according to claim 18, wherein the shape of the cross-section of each channel is rectilinear.

22. A transmission line according to claim 18, wherein the shape of the cross-section of said channel is curvilinear.

23. A feed network for a microwave antenna comprising:

a first layer of conductive material having a first surface in which a first channel devoid of said material is formed, said first channel extending in a first direction, and in which a second channel devoid of said material is formed, said second channel extending in a second direction different from said first direction and intersecting said first channel, and wherein the bottom of said first channel is contiguous with the bottom of said second channel;

a first insulator layer-surrounded conductor disposed in said first channel, the surrounding insulator of said first insulator-surrounded conductor only partially occupying the available space in said first channel external to said first conductor;

a second insulator layer-surrounded conductor disposed in said second channel, the surrounding insulator of said second insulator-surrounded conductor only partially occupying the available space in said second channel external to said second conductor;

a second layer of conductive material formed over said first and second channels in which said first and second insulator-surrounded conductors are respectively disposed;

a layer of dielectric material disposed on a second surface of said first layer of conductive material and having a plurality of apertures therethrough intersecting said first and second channels at locations thereof corresponding to a prescribed pattern; and a plurality of antenna elements disposed on said layer of dielectric material at the locations of said apertures and being connected to respective portions of said first and second conductors exposed by said apertures.

24. A feed network according to claim 23, wherein the depths of said channels are less than the outer diameters of said conductors.

25. A feed network according to claim 24, wherein said first layer of conductive material comprises a thin conductive plate and said first and second insulator-surrounded conductors comprise respective first and second dielectric-jacketed fine diameters wires disposed in said first and said second channels, respectively.

26. A transmission line according to claim 25, wherein said second layer of conductive material comprises a layer of conductive foil covering said channels and contacting the dielectric jackets of said wires and said first surface of said thin conductive plate.

27. A transmission line for use at microwave frequencies comprising:

a first layer of conductive material having a first surface in which a channel devoid of said material is formed;

an insulator-surrounded conductor disposed in said channel, the surrounding insulator of said insulator-surrounded conductor only partially occupying the available space in said channel external to said conductor;

a second layer of conductive material formed over said channel in which said insulator-surrounded conductor is disposed; and wherein said channel has side walls whose depth is less than the outer diameter of said insulator-surrounded conductor.

28. For use in effecting electrical signal transmission at microwave frequencies relative to lead conductors on an integrated circuit chip provided in a chip support package, a signal transmission link arrangement comprising:

a first layer of conductive material disposed adjacent to the lead conductors on said integrated circuit chip and respective signal connection terminals spaced apart therefrom;

a plurality of dielectric-surrounded conductors overlying said first layer of conductive material, opposite ends of each of said dielectric-surrounded conductors being respectively electrically coupled to a lead conductor on said chip and a signal connection terminal; and a second layer of conductive material formed over said dielectric-surrounded conductors and being electrically connected with said first layer of conductive material; and wherein said first layer of conductive material comprises a first portion adjacent to said chip in a first surface of which a plurality of channels devoid of conductive material are formed, first end portions of said dielectric surrounded conductors being disposed in said channels, and a second portion extending between said first portion and said signal connection terminals; and wherein one end of each of said conductors extends from surrounding dielectric into electrical contact with a lead of said chip; and wherein said second layer of conductive material is formed over said electrical contact thereat.

29. A signal transmission link arrangement according to claim 28, wherein said second layer of conductive material comprises a layer of conductive foil covering said channels and conforming with the shape of said dielectric surrounded conductors over said second portion of said first layer of conductive material.

30. A transmission line for use in microwave frequencies comprising:

a first layer of conductive material having a first surface in which a channel devoid of said material is formed;

an insulator-surrounded conductor disposed in said channel, the surrounding insulator of said insulator-surrounded conductor only partially occupying the available space in said channel external to said conductor;

a second layer of conductive material formed over said channel in which said insulator-surrounded conductor is disposed; and means for changing the characteristic impedance of said transmission line along said channel.

31. A transmission line according to claim 30, wherein the geometrical configuration of said channel is varied therealong thereby providing a change in the characteristic impedance of said transmission line along said channel.

32. A transmission line according to claim 30, wherein the depth of said channel is varied therealong to thereby effect said change in the characteristic impedance of said transmission line.

33. A transmission line according to claim 30, wherein the size of said channel is varied therealong to thereby effect said change in the characteristic impedance of said transmission line.

34. A transmission line according to claim 30, wherein the shape of said channel is varied therealong to thereby effect said change in the characteristic impedance of said transmission line.

35. A transmission line according to claim 30, wherein the width of said channel is varied therealong to thereby effect a change in the characteristic impedance of said transmission line.

36. A transmission line for use in microwave frequencies comprising:

a first layer of conductive material having a first surface in which a channel devoid of said material is formed;

an insulator-surrounded conductor disposed in said channel, the surrounding insulator of said insulator-surrounded conductor only partially occupying the available space in said channel external to said conductor;

a second layer of conductive material formed over said channel in which said insulator-surrounded conductor is disposed; and wherein the ratio of the radius of said conductor to that of the insulator and the conductor surrounded thereby is varied therealong thereby providing a change in the characteristic impedance of said transmission line along said channel.

* * * * *